United States Patent [19]

Shida et al.

[11] Patent Number: 4,742,324

[45] Date of Patent: May 3, 1988

[54] SHEATH HEATER

[75] Inventors: Yoshiaki Shida, Ikoma; Hisao Fujikawa, Nishinomiya; Nobuyuki Maruyama, Amagasaki; Shunichiro Akiyama, Joetsu, all of Japan

[73] Assignees: Sumitomo Metal Industries Ltd., Osaka; Nippon Stainless Steel Co., Ltd., Tokyo, both of Japan

[21] Appl. No.: 52,216

[22] Filed: May 20, 1987

Related U.S. Application Data

[63] Continuation of Ser. No. 727,217, Apr. 25, 1985, abandoned.

[30] Foreign Application Priority Data

Apr. 27, 1984 [JP] Japan ..... 59-85554

[51] Int. Cl.[4] ..... H01C 1/03

[52] U.S. Cl. ..... 338/238; 219/544; 148/327; 148/909

[58] Field of Search ..... 219/534, 544; 338/238-251; 148/327, 909; 428/586; 420/43, 52-54; 138/177, DIG. 6

[56] References Cited

U.S. PATENT DOCUMENTS

| | | | |
|---|---|---|---|
| 3,306,736 | 2/1967 | Rundell | 75/128 N |
| 3,551,142 | 12/1970 | Decroix | 75/128 N |
| 3,940,267 | 2/1976 | Mimino et al. | 75/128 T |

FOREIGN PATENT DOCUMENTS

| | | | |
|---|---|---|---|
| 2548945 | 5/1976 | Fed. Rep. of Germany | 338/238 |
| 48-73321 | 10/1973 | Japan . | |
| 52-149213 | 12/1977 | Japan . | |
| 54-24214 | 2/1979 | Japan . | |
| 54-42325 | 4/1979 | Japan . | |
| 54-150751 | 11/1979 | Japan | 338/238 |
| 55-21547 | 2/1980 | Japan . | |
| 55-107762 | 8/1980 | Japan . | |
| 55-100966 | 8/1980 | Japan . | |
| 56-81658 | 7/1981 | Japan . | |
| 57-23050 | 2/1982 | Japan | 420/584 |
| 57-203738 | 12/1982 | Japan . | |
| 57-207148 | 12/1982 | Japan . | |
| 57-210939 | 12/1982 | Japan . | |
| 58-110660 | 7/1983 | Japan | 75/128 W |
| 1183547 | 3/1970 | United Kingdom | 75/128 T |

*Primary Examiner*—Deborah Yee

*Attorney, Agent, or Firm*—Burns, Doane, Swecker & Mathis

[57] ABSTRACT

A corrosion-resistant steel tube such as a sheath heater steel tube and boiler tube which exhibit improved resistance to dry corrosion under high temperature dry-corrosive conditions in the presence of chlorides is disclosed. The steel consists essentially of, in % by weight:

C: not more than 0.05%,

Si: 0.1-2.0%, Mn: not more than 2.0%,

Cr: 18-26%, Ni: 16-30%, at least one of Mo: 0.5-4.0%, W: 0.01-4.00%, and

V: 0.01-4.00%,

N: 0-0.25%, (Ti+Nb): 0-1.5%, and the balance iron and incidental impurities.

8 Claims, 1 Drawing Sheet

SHEATH HEATER

This application is a continuation of application Ser. No. 727,217 filed Apr. 25, 1985, now abandoned.

BACKGROUND OF THE INVENTION

The present invention relates to steel tubes such as a sheath heater tube and black liquor heat recovery boiler tube, which are used under chloride-containing high temperature dry corrosion conditions.

That is, the present invention relates to a sheath heater steel tube exhibiting markedly improved resistance to dry corrosion at high temperatures. The present invention also relates to a black liquor heat recovery boiler tube for use in burning waste such as black liquor.

More particularly, the present invention relates to a tube which contacts a relatively concentrated chloride-containing substance or contaminants containing a relatively concentrated chloride under service conditions in a dry corrosion atmosphere.

Recently, in an increasing number of apartment complexes, the use of fuel gases is being restricted so as to avoid accidents due to gas leakage and reduce the possibility of fires at the time of earthquakes. Accordingly, electrical cooking appliances have been becoming increasingly popular.

Electrical cooking appliances such as cooking stoves and broilers for fish employ a sheath heater which generates heat at a maximum in the range of from 800° to 900° C. A sheath heater is a heater in which an electric heating element is embedded in an electrically insulating powder packed in a sheath, hereunder called a "sheath heater tube" or "sheath protector tube". For such a use, even the steel which resists oxidation under usual atmospheric conditions exhibits extremely poor resistance when it contacts soy sauce, mayonnaise, cooking salt or the like. This is because soy sauce usually contains 5% or more of NaCl. Thus, even if a protector tube for the sheath heater is made of a steel which exhibits generally good corrosion resistance, the sheath protector tube is easily attacked by dry chloride to cause the formation of pin holes, resulting in breakage of the heating elements.

Such high temperature corrosive conditions containing dry chlorides are found not only in electric cooking appliances, but also in incinerators for waste such as waste pulp liquor (black liquor), rubbish and the like.

Thus, a heat-exchanging boiler for use in burning waste pulp liquor cannot avoid contact with a 1% or more NaCl-containing atmosphere. A structural member of an incinerator, when a vinylchloride resin is burned, necessarily comes into contact with the HCl and $Cl_2$ gases generated during combustion of the vinylchloride resin. Therefore, a means for achieving improved resistance to dry corrosion at high temperatures is urgently needed for these applications.

For a better understanding of the present invention, it is helpful herein to distinguish the atmosphere in which electric cooking appliances and incinerators mentioned above are used from that containing water, including high temperature or high pressure water. The former type is substantially free from liquid water, i.e. it is a dry corrosive environment, the corrosion mechanism of which is quite different from that of a so-called wet-corrosive environment. Namely, when a steel member is heated or is placed in a combustion gas in the presence of chlorides, oxidation as well as formation of sulfides occur, although the steel is totally free from stress-corrosion cracking or pitting which results in other severe problems in the presence of water.

When NaCl contacts a steel surface at a high temperature, the NaCl reacts with the Fe of the steel to form $NaFeCl_4$ which is highly volatile and which accelerates dry corrosion. In addition, since free HCl and $Cl_2$ form chlorides of Fe and Cr at a high temperature, corrosion is also accelerated. Furthermore, in an oxidizing atmosphere, the thus formed chloride then turns into an oxide, thus accelerating the dry corrosion through a corrosion cycle. Although under usual atmospheric conditions the once-formed $Cr_2O_3$ layer exhibits protective duty and can resist oxidation, the presence of NaCl results in a porous oxide of $(Fe, Cr)_2O_3$ or $(Fe, Cr)_3O_4$, which is less resistant to oxidation.

Thus, means for achieving corrosion resistance under aqueous conditions cannot be directly applied to high temperature dry corrosion resistance in the presence of NaCl.

In the past it was reported that the addition of nickel is effective to improve corrosion resistance in a high temperature dry corrosive atmosphere containing chlorides. Therefore, as sheath heater tubes of electric cooking appliances, Incoloy 800 (Trademark for alloys of 21Cr-32Ni-Ti-Al-Bal. Fe), Incoloy 600 (Trademark for alloys of 15Cr-Bal. Ni), AISI 310S, 309S, and the like have been used. As boiler tubes for use in burning wastes, stainless steels such as AISI 321H or 304 have been used. In the form of bare tubes or coextruded tubes the steel mentioned above is used constituting an outer tube depending on the location in the boiler. In some cases, a cladding tube prepared by a metal spraying method is also used.

However, there is a decisive problem in these prior art materials that those containing a relatively large amount of nickel are very expensive, while those containing a small amount of nickel do not exhibit satisfactory properties. For example, if AISI 304 steel is used for boiler tubes for burning waste, it is required that the temperature of the boiler tube be restricted to lower than 500° C. so as to lower the corrosion rate, which results in a decrease in thermal efficiency.

A metallic member used in these high temperature corrosive circumstances should exhibit not only improved resistance to corrosion in a high temperature dry corrosive atmosphere in the presence of chlorides, but also satisfactory high temperature strength, weldability, bending formability, and long-term stability of its chemical and physical properties. In view of these properties, the materials mentioned above have been selected for use in the past. However, the materials now available on the market are not satisfactory in respect to properties including resistance to corrosion under high temperature dry corrosive atmospheres.

In particular, a steel employed as a sheath heater tube must possess a uniform appearance and a high thermal radiation efficiency. Sometimes for the purposes of improving thermal radiation efficiency a black scale is formed on the surface by annealing. Therefore, the steel composition has to be so formulated that a satisfactory black scale can be easily formed during annealing.

Under these circumstances, a high temperature dry corrosion-resistant steel material which possesses all the above mentioned properties at satisfactory levels and is less expensive is highly desired.

SUMMARY OF THE INVENTION

A primary object of the present invention is to provide a less expensive sheath heater steel tube which solves the above-mentioned prior art problems and exhibits much improved resistance to dry corrosion in the presence of chlorides at high temperatures. The tube should also exhibit improved high temperature strength, a long-term high temperature stability, weldability, and bending formability.

Another object of the present invention is to provide a less expensive heat recovery steel boiler tube which solves the above-mentioned prior art problems and exhibits much improved resistance to dry corrosion in the presence of chlorides at high temperatures.

Still another object of the present invention is to provide a less expensive sheath heater tube to be used in electric cooking appliances with a long service life.

Still another object of the present invention is to provide a less expensive sheath heater tube to be used under dry-corrosive conditions at a temperature of 800° C. or higher at maximum in the presence of chlorides including alkali metal chlorides, hydrogen chloride gas, chlorine gas, and the like.

In order to achieve the objects mentioned above, the inventors carried out intensive study of dry corrosion at high temperatures in an environment containing chlorides and found the following:

(a) It has been confirmed that the corrosion resistance under high temperature dry-corrosive conditions containing chlorides such as an atmosphere where salt (NaCl) contacts a steel tube surface at a high temperature is markedly improved by the addition of a certain amount of Ni. Unexpectedly, however, the addition of Mo, W, or V to steel may also improve the resistance to corrosion in the presence of chlorides. These alloying elements are known in the art as elements which improve high temperature strength and further improve the resistance to stress corrosion cracking and pitting, which occur in a totally different way in aqueous conditions.

(b) The incorporation of C (carbon) in a steel impairs corrosion resistance of steel in a high temperature dry corrosion atmosphere containing chlorides. Therefore, not only by reducing the carbon content of the conventional high-nickel steel, but also by adding a given amount of Mo, W, or V, it is possible to obtain a satisfactory level of corrosion resistance under chloride-containing dry-corrosive atmosphere at high temperatures.

(c) When Cr is also present, in addition to the above elements, the oxidation resistance is ensured at a high temperature.

(d) In order to insure that the steel whose alloy composition has been adjusted as in the above will exhibit formability including bending formability and satisfactory ductility after long-time aging, it is advisable that the alloy composition be adjusted to provide virtually a single austenitic phase.

(e) When nitrogen, Ti, or Nb is added to the steel, the high temperature strength is further improved.

(f) It is possible to provide a low-Ni steel which exhibits markedly improved resistance to high temperature dry corrosion in the presence of chlorides, though the nickel content is rather small, by means of formulating the steel composition first in consideration of a high temperature strength, and metallurgical structural stability, and by reducing the carbon content and adding a given amount of Mo, W, or V.

(g) Sometimes it is necessary to form a black scale on the surface of the tube by annealing. Upon heating in an atmosphere with a high oxygen potential such as in air, a protective black scale comprising oxides of Fe and Cr is formed. In a low oxygen potential atmosphere with an oxygen potential at a level such that ferrous oxide does not form, a protective scale forms which comprises oxides of Mn and Cr. However, depending on the steel composition and changes of atmospheric conditions, sometimes the formed scale turns a little greenish. In order to achieve a uniform and genuine black color, titanium in an amount of 0.1% or more may be added to the steel.

Thus, the present invention provides a sheath heater steel tube exhibiting improved resistance under high temperature dry-corrosive conditions in the presence of chlorides, the steel composition being in % by weight:

C: not more than 0.05%,
Si: 0.1–2.0%, Mn: not more than 2.0%,
Cr: 18–26%, Ni: 16–30%,
at least one of Mo: 0.5–4.0%, W: 0.01–4.00%, and V: 0.01–4.00%,
optionally N: 0.02–0.25%, and/or at least one of Ti and Nb in a total amount of 1.5% or less, and
the balance iron and incidental impurities.

Thus, according to the present invention, a sheath heater steel tube and black liquor heat recovery boiler tube are provided, exhibiting markedly improved high temperature dry corrosion resistance in the presence of chlorides without addition of much amount of nickel, while the steel possesses requisite mechanical and chemical properties as usual high temperature steels. The sheath heater comprising the sheath heater tube of the present invention, therefore, has a long service life in spite of its low material cost.

DESCRIPTION OF THE PREFERRED EMBODIMENTS

Figure 1:
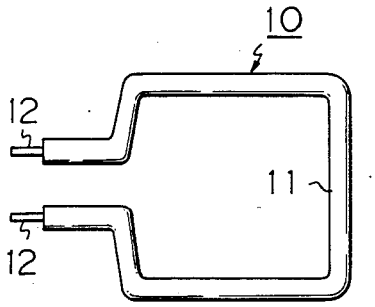
FIG. 1 is a plan view of a sheath heater tube of the present invention.

FIG. 1 is a plan view of an electric sheath heater 10 comprising a sheath heater tube 11 in which an electric heating element is packed together with an electrically insulating powder such as MgO. The sheath heater 10 is installed in an electric broiler, electric oven, and the like, and the protective tube is exposed to a corrosive atmosphere containing chlorides at high temperatures. The protective tube is usually manufactured by means of electric arc welding. Numerals 12 and 12 indicates leads to the electric heating element.

The sheath heater is required to have a long service life at a temperature of 800° C. or higher. Therefore, the material for manufacturing the tube is required to have good resistance against attack by chlorides at high temperatures.

Therefore, according to the present invention, the sheath heater tube produced from a steel having an alloy composition defined in the above exhibits a service life of twice as long as that made from Incoloy 800 under severely corrosive conditions such as found in electric cooking appliances.

The reasons why the steel composition of the present invention is defined as in the above will be described in detail.

C (Carbon):

Carbon is an element which is effective for securing high temperature strength. However, if carbon is added excessively, the high temperature corrosion resistance is much impaired due to the presence of chlorides, and the weldability is also impaired. Especially, when the carbon content is over 0.05%, these tendencies greatly increase, and therefore the carbon content is defined as being 0.05% or less. Although it is desirable to restrict the carbon content to 0.035% or less in order to avoid intergranular attack, there are no adverse effects when the carbon content is 0.05% or less.

Si (Silicon):

The incorporation of silicon serves to improve the corrosion resistance in a high temperature environment in the presence of chlorides. Silicon is also effective as a deoxidizing agent.

However, when the amount added is less than 0.1%, none of the intended effects are achieved. On the other hand, when the silicon content is larger than 2.0%, weldability of a single austenitic steel of the present invention with a high nickel content is degraded. Since a high silicon content accelerates the precipitation of sigma phase, which impaires ductility as well as toughness after a long period of service. According to the present invention, therefore, the silicon content is defined as 0.1–2.0% and preferably 0.1–1.2 %.

Mn (Manganese):

Manganese is an element necessary for securing hot workability of steel. When it is added in an amount of more than 2.0%, the resistance to high temperature dry corrosion in the presence of chlorides is impaired. The upper limit of manganese is 2.0%. Preferably the manganese content is 0.1–1.5%.

Cr (Chromium):

Chromium is effective for improving the resistance to chloride-containing high temperature environments. It is also effective for improving oxidation resistance in general at a high temperature of about 900° C. However, when the chromium content is less than 18%, the desired effects cannot be achieved. As the chromium content increases, the high temperature oxidation resistance of the steel is improved accordingly, but when an excess amount of Cr is added, a much higher nickel content is required not only to maintain a single austenitic steel to prevent degradation in mechanical properties after long-term aging, but also to secure weldability.

In addition, when the addition of Cr in an amount greater than 26% is carried out, no additional improvement is obtained. Therefore, the Cr content is restricted to 18–26% and preferably 18–22%.

Ni (Nickel):

Nickel is a very important element to improve resistance to high temperature dry corrosion in the presence of chlorides, and is also important for the maintenance of a single austenitic phase. However, when nickel is contained in an amount of less than 16%, the intended effect cannot be obtained.

The higher the nickel content the more the high temperature corrosion resistance in the presence of chlorides is improved. However, for reasons of economy, the upper limit thereof is 30%. Therefore, according to the present invention, the nickel content is defined as 16–30% and preferably 18–26%.

Mo, W, and V:

These elements are important to improve corrosion resistance in a high temperature environment containing chlorides. For this purpose, at least one of these elements is added. The reasons therefor will be further explained for each element.

(i) Mo (Molybdenum):

Molybdenum is an expensive element. The addition of M adds to material cost like the addition of nickel. Mo is markedly effective for improving the corrosion resistance in the presence of chlorides at high temperatures.

Mo is 10 times more effective than nickel. The addition of 0.5% or more of Mo is significant. As the Mo content increases, the more the corrosion resistance is improved. When Mo is added in an amount of more than 4.0%, the improvement in corrosion resistance is not significant in view of the resulting increase in material cost.

In order to stabilize the metallurgical structure, an increasing Mo content requires an increasing Ni content. This is not desirable from the viewpoint of economy. The Mo content is restricted to 0.5–4.0%, when it is added. Preferably the Mo content is 0.5–2.5%.

(ii) W and V:

W and V are effective to improve the corrosion resistance in the presence of chlorides at high temperatures. The addition of a small amount of these elements markedly improves the above-mentioned corrosion resistance. For this purpose the addition of at least 0.01% of each is necessary, when they are added. For either element, when the amount added is more than 4.0%, the precipitation of intermetallic compounds is accelerated, impairing workability. Thus, the content of each of these elements is restricted to 0.01–4.00%. Preferably, these elements are added together with Mo.

In these respects, it has been acknowledged in the art that the addition of Mo, W and/or V is harmful or not advantageous with regards to corrosion resistance in a high temperature oxidizing atmosphere or in a high temperature corrosive atmosphere. Especially, it has been thought that the formation of $MoO_3$, $WO_3$, or $V_2O_3$ in a high temperature oxidizing atmosphere accelerates oxidation at high temperatures, since they are low melting point substances. The addition of these elements also causes the acceleration of corrosion at high temperatures in the presence of alkali fused salts such as $Na_2SO_4$.

Thus, under usual conditions, these elements have not been added to steels for use in a high temperature corrosive atmosphere. These elements have been added only for the purpose of improving high temperature strength.

Therefore, the prior art in no way suggests the addition of Mo, W, and V to a steel which is used in the presence of chlorides in a high temperature dry-corrosive environment.

N (Nitrogen):

Nitrogen serves to improve the high temperature strength of steel. Therefore, in the present invention nitrogen is intentionally added so as to further improve high temperature strength. When it is added in an amount of less than 0.02%, significant effects canno be obtained.

Nitrogen is a less expensive austenite former and unlike carbon is not harmful to high temperature corrosion resistance. Rather, the addition of nitrogen is effective for improving high temperature corrosion resistance when 0.1% or more of nitrogen is added.

However, when more than 0.25% of nitrogen is added, weldability deteriorates. Therefore, the nitrogen content is defined as 0.02–0.25%.

Ti and Nb:

These elements are also effective for improving the high temperature strength of steel. Therefore, if necessary, at least one of these elements is added. Especially, when it is desirable to furthere improve strength, both Ti and Nb are added.

It is also advisable to add titanium in an amount of 0.1% or more when it is necessary to prepare a stable and uniform black skin by annealing in a low oxygen potential atmosphere. Preferably, titanium is added in an amount of 0.20–0.40%.

The total amount of Ti and Nb is preferably 0.1% or more. However, when Ti is added excesssively, the number of steel surface flaws increases. In the case of Nb, the weldability deteriorates. Thus, the total amount of Ti and Nb is restricted to 1.5% or less. When Nb is added together with nitrogen, the content of Nb is restricted preferably to 1.0% or less.

In addition to the alloying elements mentioned above, 1% or less of Al, 0.1% or less of at least one of B, Ca, rare earth elements, and Y, and Cu in an amount of 1% or less may be incorporated separately or in combination without imparting any adverse effects to the steel tube of the present invention.

Regarding incidental impurities, the lower the amount of impurities such as P and S the better. It is desirable to restrict the content of P to 0.02% or less, and the content of S to 0.003% or less.

It is preferable that a combined addition of Ti+N or V+N be avoided, since the cleanliness of steel is impaired when these elements are added, although no significant effects are produced on the high temperature dry corrosion resistance in the presence of chlorides.

It is herein to be noted that there have been proposed a variety of heat-, wet corrosion-resistant steels in Japanese Laid-Open Specification Nos. 48-73321, 52-149213, 54-24214, 54-42325, 55-21547, 55-100966, 55-107762, 56-81658, 57-203738, 57-207148, and 57-210939. However, the steels which are disclosed therein are steels resistant to stress corrosion cracking, pitting corrosion or steam oxidation although they have a chemical composition partly similar to that of the present invention, and some of them are merely high temperature strength steels.

The inventors of the above-mentioned steels did not realize how severe a dry-corrosive atmosphere can be in the presence of chlorides such as NaCl. Furthermore, none of the above specifications teach or suggest the production of sheath heater tubes or black liquor boiler tubes.

The present invention will be further described in conjunction with working examples thereof, which are presented merely for illustrative purposes.

EXAMPLE 1

Steel samples the alloy compositions of which are shown in Table 1 were vacuum-melted to give 10 Kg ingots. Through hot forging, hot rolling, and cold rolling, steel sheets 5 mm thick were prepared.

The resulting steel sheets were heated at 1100° C. for 30 minutes and after water quenching corrosion test pieces 3 mm thick, 10 mm wide, and 30 mm long were cut therefrom.

The following two types of high temperature corrosion tests were carried out with NaCl adhering to the test pieces under the below-mentioned Conditions A and Conditions B.

Conditions A:

An NaCl-saturated aqueous solution (NaCl: 26.5%) was prepared. Before starting the test a test piece was dipped into the aqueous solution, then heated at 800° C. for 20 minutes, and cooled for 10 minutes. This heating-cooling cycle was repeated 50 times. After that the test piece was dipped into the NaCl-saturated aqueous solution, then heated at 800° C. for 20 minutes, and cooled for 10 minutes. This heating-cooling cycle was repeated 50 times. Then the former and latter cycles were repeated until the repeated heating-cooling cycles were carried out 200 times.

Conditions B:

A combined ash (70%$Na_2SO_4$+5% $Na_2CO_3$ +25%NaCl) was coated on the test piece surface in an amount of 30 mg/cm$^2$ and the thus coated test piece was subjected to oxidation at 600° C. for 500 hours in a combined gaseous stream ($N_2$+15%$CO_2$+3%$O_2$+1.0-%$SO_2$).

After carrying out the above test, the test pieces were descaled and the weight losses were weighed to determine the rate of corrosion for each test piece. The weight loss was converted into a section thickness loss.

In the case of Conditions A, since internal attack took place severely, the descaled test piece surface was examined by means of a microscope to determine the internal attacking depth. Adding the thus-obtained depth to the above-mentioned thickness loss which is calculated on the basis of the weight loss, the indicated thickness loss was obtained.

The results obtained from the above tests are summarized in Table 1.

As is apparent from the data shown in Table 1, in the corrosion test under Conditions A, the steel of the present invention exhibited a section thickness loss of 0.4 mm or less. It is apparent the corrosion resistance of the steel of the present invention is much improved in comparison with those of the comparative steels except for that of Steel No. 13 (Inconel 600 - Trademark).

Needless to say, Steel No. 13 is a nickel-based alloy and is very expensive.

According to the corrosion test under Conditions B, the steel of the present invention is superior to the comparative steels.

Figure 2:
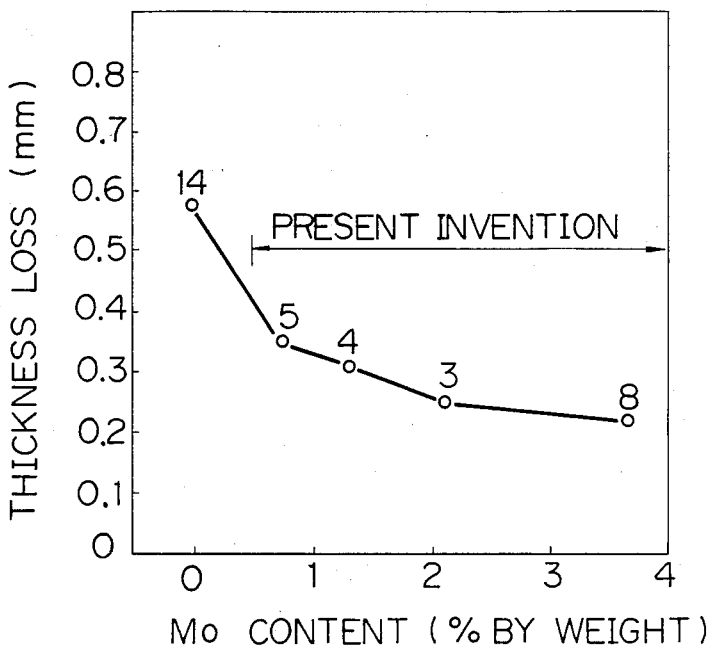
FIG. 2 is a graph showing the relationship between the thickness loss and the Mo content of steel.

FIG. 2 of the accompanying drawings is a graph showing the relationship between the Mo content and corrosion loss under Conditions A for 20Cr-25Ni steels.

The numerals shown in the drawing correspond to the steel numbers of Table 1. It is apparent from the graph that the addition of Mo is effective for improving corrosion resistance.

EXAMPLE 2

In this example, test pieces having the alloy compositions shown in Table 2 were prepared in accordance with the same procedures as for in Example 1.

The corrosion tests were also carried out under the same conditions as in Example 1.

The test results are summarized in Table 2.

As is apparent from the results shown therein, the steel of the present invention exhibited a thickness loss of 0.32 mm or less under Conditions A, which is the same as for Steel No. 13 of Table 1.

In addition, under Conditions B the steel of the present invention exhibited a thickness loss of 0.05 mm or less. This means that the sheath heater tube made therefrom exhibits much improved resistance to high temperature dry corrosion when installed in an electric oven and the like.

High temperature strength, weldability, and bending formability of the present invention steel were confirmed to be comparable to that of usual high temperature steels.

Thus, according to the present invention, it is possible to provide a steel tube which exhibits improved corrosion resistance in a high temperature dry corrosion atmosphere. The steel tube also exhibits satisfactory high temperature strength, long term thermal stability, weldability, and bending formability. Furthermore, the material cost of the steel tube of the present invention is very low, since the nickel content is restricted to a lower level.

Thus, the sheath heater steel tube of the present invention is useful as a protector tube of electric cooking appliances, which is easily contaminated with NaCl-containing substances.

The steel employed in this invention is also useful in preparing an incinerator member for use in burning wastes containing halogen gas or halides. The steel may also be useful in preparing a boiler tube for burning wastes containing halogen gas or halides or a boiler tube for burning coal with a high content of Cl.

The steel may also be used as a tubing material, i.e. a sheet for producing a welding pipe, or as a plain plate, as a cladded plate, or as a double-walled tube.

Although the present invention has been described with respect to preferred embodiments it is to be understood that variations and modifications may be employed without departing from the concept of the invention as defined in the following claims.

TABLE 1

| Steel No. | Chemical Composition (% by weight) | | | | | | | | | Corrosion Test Results (Thickness Loss, mm) | | Remarks |
|---|---|---|---|---|---|---|---|---|---|---|---|---|
| | C | Si | Mn | Cr | Ni | Mo | N | Others | Fe+ Impurities | Under Conditions A | Under Conditions B | |
| Invention Steel | | | | | | | | | | | | |
| 1 | 0.015 | 0.61 | 0.95 | 18.51 | 16.55 | 3.10 | 0.16 | — | Bal. | 0.37 | 0.050 | — |
| 2 | 0.020 | 0.97 | 0.89 | 19.85 | 20.55 | 3.05 | 0.13 | — | " | 0.30 | 0.036 | |
| 3 | 0.025 | 0.95 | 0.65 | 20.55 | 24.95 | 2.10 | 0.11 | — | " | 0.25 | 0.039 | |
| 4 | 0.033 | 0.91 | 0.70 | 20.30 | 25.50 | 1.30 | 0.05 | — | " | 0.31 | 0.042 | |
| 5 | 0.018 | 1.30 | 1.25 | 20.43 | 25.35 | 0.75 | 0.09 | — | " | 0.35 | 0.049 | |
| 6 | 0.022 | 0.96 | 1.11 | 25.10 | 28.55 | 1.50 | 0.21 | — | " | 0.26 | 0.034 | |
| 7 | 0.043 | 0.97 | 0.75 | 20.45 | 23.95 | 2.06 | — | — | " | 0.28 | 0.042 | |
| 8 | 0.009 | 0.91 | 0.73 | 20.23 | 24.88 | 3.65 | — | — | " | 0.22 | 0.032 | |
| Comparative Steel | | | | | | | | | | | | |
| 9 | 0.045 | 0.49 | 1.41 | 18.21 | 9.10* | —* | — | — | " | 0.95 | 0.095 | SUS 304 |
| 10 | 0.049 | 0.47 | 1.49 | 16.45* | 13.00* | 2.11 | — | — | " | 0.85 | 0.073 | SUS 316 |
| 11 | 0.062* | 0.55 | 1.10 | 24.85 | 19.88 | —* | — | — | " | 0.49 | 0.060 | SUS 310 |
| 12 | 0.053* | 0.51 | 1.11 | 21.20 | 32.35* | —* | — | Ti:0.35 Al:0.29 | " | 0.65 | 0.072 | Incoloy 800 (Trademark) |
| 13 | 0.031 | 0.43 | 0.42 | 15.92* | 77.50* | —* | — | Ti:0.25 Al:0.28 | " | 0.25 | 0.090 | Inconel 600 (Trademark) |
| 14 | 0.021 | 0.46 | 1.10 | 20.05 | 25.13 | —* | — | — | " | 0.58 | 0.068 | — |

Note:
Outside the range of the present invention.

TABLE 2

| Steel No. Invention Steel | Chemical Composition (% by weight) | | | | | | | | | | | | Corrosion Test Results (Thickness Loss, mm) | |
|---|---|---|---|---|---|---|---|---|---|---|---|---|---|---|
| | C | Si | Mn | Cr | Ni | Mo | W | V | N | Nb | Ti | Fe + Impurities | Under Conditions A | Under Conditions B |
| 15 | 0.015 | 0.75 | 1.18 | 18.90 | 16.25 | 3.25 | 1.15 | — | — | — | — | Bal. | 0.32 | 0.047 |
| 16 | 0.021 | 0.65 | 1.08 | 20.51 | 21.25 | 2.95 | 1.39 | — | — | — | — | " | 0.29 | 0.044 |
| 17 | 0.009 | 0.66 | 1.03 | 19.98 | 24.35 | 1.95 | 0.09 | — | — | — | — | " | 0.23 | 0.037 |
| 18 | 0.013 | 0.74 | 1.05 | 20.08 | 24.45 | 2.10 | 0.55 | — | — | — | — | " | 0.20 | 0.035 |
| 19 | 0.033 | 0.85 | 0.99 | 20.16 | 25.51 | 2.07 | 2.05 | — | — | — | — | " | 0.16 | 0.026 |
| 20 | 0.042 | 0.76 | 0.87 | 25.10 | 24.98 | 2.05 | 1.03 | — | — | — | — | " | 0.18 | 0.029 |
| 21 | 0.023 | 0.95 | 0.95 | 19.75 | 24.35 | 1.05 | 0.98 | — | — | — | — | " | 0.28 | 0.044 |
| 22 | 0.018 | 0.86 | 1.12 | 20.10 | 25.11 | 0.59 | 2.28 | — | — | — | — | " | 0.22 | 0.035 |
| 23 | 0.019 | 1.29 | 1.03 | 24.10 | 20.32 | 2.35 | 0.95 | — | 0.131 | — | — | " | 0.19 | 0.031 |
| 24 | 0.021 | 0.86 | 0.48 | 20.31 | 26.38 | — | 2.85 | — | — | — | — | " | 0.031 | 0.045 |
| 25 | 0.020 | 0.92 | 0.52 | 20.26 | 25.96 | — | — | 2.15 | — | — | — | " | 0.032 | 0.047 |
| 26 | 0.025 | 0.59 | 1.07 | 18.95 | 17.85 | 3.21 | 2.01 | — | 0.085 | — | — | " | 0.30 | 0.044 |
| 27 | 0.023 | 0.74 | 1.12 | 20.21 | 23.99 | 2.03 | 0.12 | 0.11 | — | — | — | " | 0.20 | 0.033 |
| 28 | 0.026 | 0.64 | 0.89 | 20.15 | 24.35 | 2.06 | 0.13 | 1.98 | — | — | — | " | 0.19 | 0.028 |
| 29 | 0.021 | 0.63 | 1.11 | 20.03 | 23.85 | 1.98 | 0.08 | — | — | 0.13 | — | " | 0.25 | 0.039 |
| 30 | 0.022 | 0.71 | 1.05 | 19.99 | 24.25 | 2.01 | 0.11 | — | — | — | 0.49 | " | 0.24 | 0.037 |
| 31 | 0.031 | 0.55 | 1.13 | 19.78 | 24.83 | 2.00 | 0.13 | — | — | 0.14 | 0.51 | " | 0.24 | 0.038 |
| 32 | 0.022 | 0.65 | 1.21 | 19.85 | 24.75 | 2.15 | 0.07 | 0.15 | — | — | — | " | 0.24 | 0.037 |
| 33 | 0.023 | 0.63 | 1.03 | 20.35 | 24.61 | 1.96 | 0.19 | — | 0.051 | 0.25 | — | " | 0.25 | 0.037 |
| 34 | 0.014 | 0.61 | 1.11 | 20.14 | 24.55 | 1.98 | 0.13 | 0.15 | — | 0.15 | — | " | 0.26 | 0.040 |
| 35 | 0.018 | 0.67 | 1.12 | 20.13 | 24.75 | 2.10 | 0.14 | 1.05 | — | — | 0.33 | " | 0.21 | 0.034 |
| 36 | 0.024 | 0.63 | 1.06 | 20.11 | 24.78 | 2.04 | 0.48 | 0.21 | — | 0.41 | 0.31 | " | 0.23 | 0.036 |

What is claimed is:

1. In a sheath heater for use in an electrical cooking appliance, said sheath heater having an electric heating element and insulating material within a steel sheath heater tube for exposure to high temperature dry-corrosive conditions in the presence of chlorides, the improvement which comprises said steel sheath heater tube consisting essentially of, in % by weight:

C: No more than 0.05%,

Si: 0.1–2.0%, Mn: not more than 2.0%,

Cr: 18–26%, Ni: 16–30%, at least one element selected from the group consisting of Mo: 0.5–4.0%, W: 0.01–4.00%, and V: 0.01–4.00%, and the balance iron and incidental impurities.

2. In the sheath heater of claim 1, the further improvement wherein the steel contains Mo in an amount of from 0.5–2.5%.

3. In the sheath heater of claim 1, wherein the steel contains Cr in an amount of from 18–22%, Ni in an amount of from 18–26% and Mo in an amount of from 0.5 to 2.5%.

4. In the sheath heater of claim 3, wherein the steel contains N in an amount of from 0.02–0.25%.

5. In the sheath heater of claim 3, wherein the steel contains at least one of Ti and Nb in a total amount of 1.5% or less and N in an amount of from 0–0.25%.

6. In the sheath heater of claim 5, wherein the steel contains Ti in an amount of from 1.5% or less.

7. In the sheath heater of claim 6, wherein the steel contains N in an amount of from 0.02–0.25%.

8. In the sheath heater of claim 5, wherein the steel contains N in an amount of from 0.02–0.25%.

* * * * *